US011167585B2

(12) United States Patent
Muthiah et al.

(10) Patent No.: US 11,167,585 B2
(45) Date of Patent: Nov. 9, 2021

(54) AIR TIGHT PAINT BRUSH AND ROLLER STORAGE CONTAINER

(71) Applicants: Palanikkumaran Muthiah, Sylvania, OH (US); Pravinabahen Parmar, Sylvania, OH (US)

(72) Inventors: Palanikkumaran Muthiah, Sylvania, OH (US); Pravinabahen Parmar, Sylvania, OH (US)

( * ) Notice: Subject to any disclaimer, the term of this patent is extended or adjusted under 35 U.S.C. 154(b) by 0 days.

(21) Appl. No.: 16/410,358

(22) Filed: May 13, 2019

(65) Prior Publication Data

US 2019/0344609 A1 Nov. 14, 2019

Related U.S. Application Data

(60) Provisional application No. 62/683,180, filed on Jun. 11, 2018, provisional application No. 62/670,321, filed on May 11, 2018.

(51) Int. Cl.
*B44D 3/12* (2006.01)

(52) U.S. Cl.
CPC ..... *B44D 3/125* (2013.01)

(58) Field of Classification Search
CPC ..... B44D 3/125; B44D 3/12; B44D 3/123; B65D 43/0216; B65D 43/0218; B65D 43/06; B65D 43/065; B65D 43/08; B65D 43/22; B65D 43/0233; B65D 35/36; B65D 45/18; B65D 45/22
USPC ..... 206/361, 15.2, 1.7, 1.9; 220/213, 229, 220/834, 835
See application file for complete search history.

(56) References Cited

U.S. PATENT DOCUMENTS 1,595,965 A * 8/1926 Johnson ..... C23D 5/00 15/104.001
3,828,389 A * 8/1974 Heisler ..... B44D 3/126 15/257.06
4,445,250 A * 5/1984 Seidl ..... B44D 3/12 15/257.06
4,547,926 A * 10/1985 Kern ..... B44D 3/126 15/257.06

(Continued)

FOREIGN PATENT DOCUMENTS

FR 3048917 A1 9/2017
WO 2017213574 A1 12/2017

OTHER PUBLICATIONS

International Search Report and Written Opinion; PCT/US2019/032006; dated Jul. 11, 2019.

*Primary Examiner* — J. Gregory Pickett
*Assistant Examiner* — Jenine Pagan
(74) *Attorney, Agent, or Firm* — Dunlap Bennett & Ludwig, PLLC; Anna L. Kinney

(57) ABSTRACT

A paint application container includes a first half and a second half. The first half includes an inner upper edge and an outer upper edge defining a continuous channel therebetween. The second half includes a continuous upper edge. The continuous upper edge of the second half aligns with and entirely fits within the continuous channel of the first half. A receptacle is defined in between the first half and the second half. The receptacle sized to fit a paint applicator therein. At least one clamp releasably couples the first half to the second half to hold the continuous upper edge within the continuous channel and create an air tight seal between the receptacle and outside air.

12 Claims, 4 Drawing Sheets

(56) References Cited

U.S. PATENT DOCUMENTS 4,746,008 A * 5/1988 Heverly ..... B65D 55/02 206/1.5
4,802,576 A * 2/1989 Kern ..... B44D 3/126 15/257.06
5,316,137 A * 5/1994 Kyllonen ..... B44D 3/126 15/257.06
5,533,228 A * 7/1996 Jarecki ..... B44D 3/126 15/257.06
5,539,950 A * 7/1996 Zar ..... A46B 17/04 134/182
5,553,701 A * 9/1996 Jarecki ..... B44D 3/126 15/257.06
5,966,902 A * 10/1999 Korycki ..... B65D 75/22 206/209
6,196,410 B1 * 3/2001 Hocking ..... B44D 3/126 206/209
6,202,837 B1 * 3/2001 Mason ..... B44D 3/123 206/1.7
6,390,430 B1 * 5/2002 Hawley ..... B44D 3/12 206/15.2
6,530,470 B2 * 3/2003 Roundy ..... B44D 3/00 15/257.06
6,910,576 B2 * 6/2005 McGrath ..... B44D 3/125 206/15.3
7,611,009 B2 * 11/2009 Youngs ..... A45C 11/00 206/361
7,658,299 B2 * 2/2010 Billado, Jr. ..... B44D 3/121 220/570
7,987,980 B1 * 8/2011 Hahn ..... B44D 3/125 206/15.2
8,087,514 B1 * 1/2012 Fulford ..... A47L 13/52 15/105
9,139,038 B1 * 9/2015 Trollen ..... B44D 3/125
2002/0157978 A1 10/2002 Roundy
2003/0111476 A1 * 6/2003 Serio, Jr. ..... A45C 13/008 220/835
2003/0188980 A1 * 10/2003 Myers ..... B44D 3/125 206/361
2004/0108236 A1 6/2004 Reed et al.
2006/0054627 A1 * 3/2006 Youngs ..... B44D 3/127 220/570
2013/0233735 A1 * 9/2013 Hurley ..... B44D 3/125 206/209
2015/0283576 A1 * 10/2015 Kellokoski ..... B05C 17/0245 134/33
2016/0089929 A1 3/2016 DePaola, Jr. et al.
2016/0229224 A1 * 8/2016 Lester, III ..... B65D 55/16

* cited by examiner

AIR TIGHT PAINT BRUSH AND ROLLER STORAGE CONTAINER

CROSS-REFERENCE TO RELATED APPLICATION

This application claims the benefit of priority of U.S. provisional application No. 62/670,321, filed May 11, 2018, and U.S. provisional application No. 62/683,180, filed Jun. 11, 2018, the contents of which are herein incorporated by reference.

BACKGROUND OF THE INVENTION

The present invention relates to paint brushes and rollers and, more particularly, to an air tight paint brush and paint roller storage container.

Wet paint brushes and paint rollers are difficult to store in-between breaks when a job is being performed, or between jobs, because the paint on brushes and rollers dry when exposed to air over a period of time, and cannot be reused.

Wet paint brushes and paint rollers are currently not stored, but manually cleaned between coats/breaks when required and between jobs for the next day. Manual cleaning of wet paint brush and paint roller is labor-intensive, inefficient, inconvenient and creates a messy process, damages the sensitive bristles and coating surfaces.

As can be seen, there is a need for an air tight paint brush and paint roller storage container.

SUMMARY OF THE INVENTION

In one aspect of the present invention, a paint application container comprises: a first half comprising an inner upper edge and an outer upper edge defining a continuous channel therebetween; a second half comprising a continuous upper edge; and at least one clamp, wherein the continuous upper edge of the second half entirely fits within the continuous channel of the first half, a receptacle is defined in between the first half and the second half, the receptacle sized to fit a paint applicator therein, and the at least one clamp releasably couples the first half to the second half to hold the continuous upper edge within the continuous channel and create an air tight seal between the receptacle and outside air.

These and other features, aspects and advantages of the present invention will become better understood with reference to the following drawings, description and claims.

DETAILED DESCRIPTION OF THE INVENTION

Figure 1:
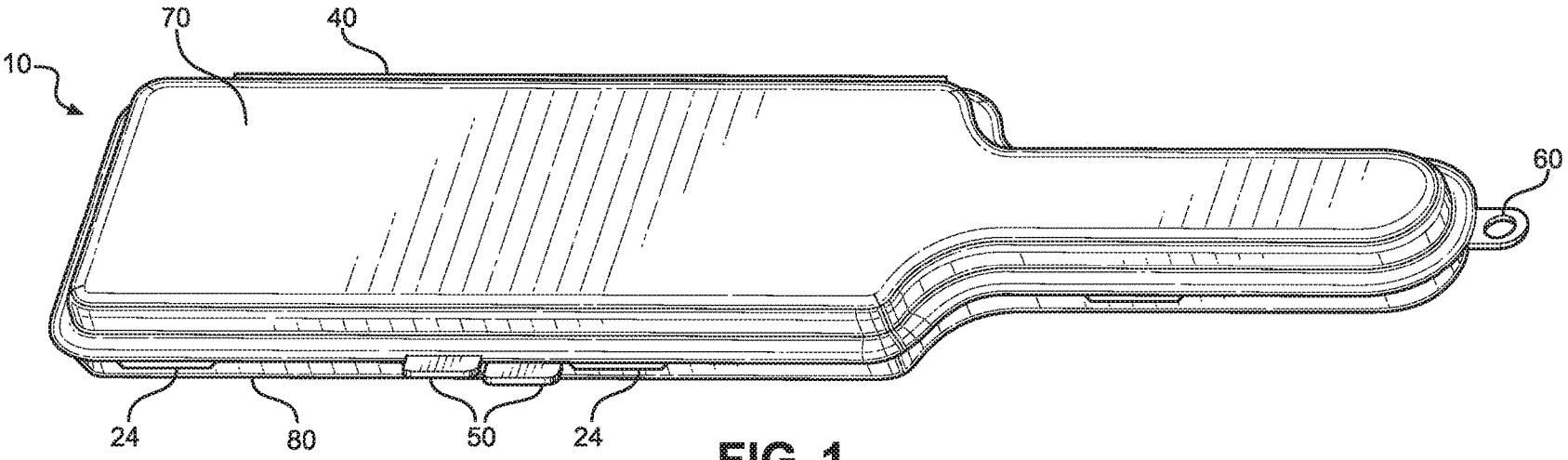
FIG. 1 is a perspective view of an embodiment of the present invention in a closed position.
Figure 2:
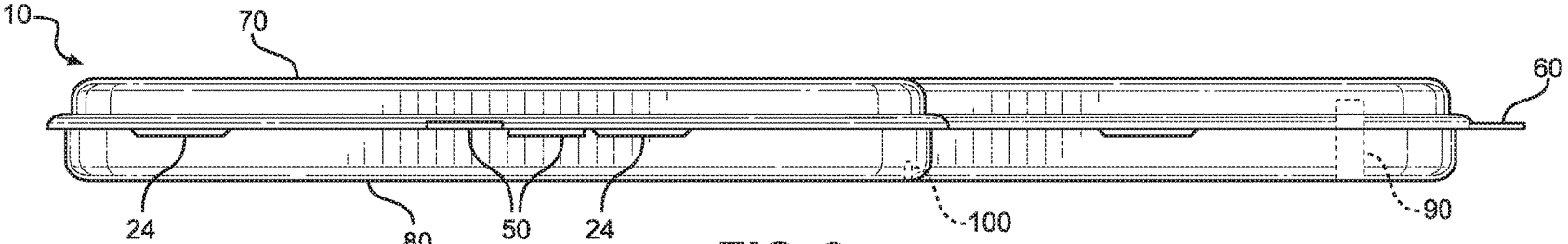
FIG. 2 is a side view of an embodiment of the present invention in a closed position.
Figure 3:
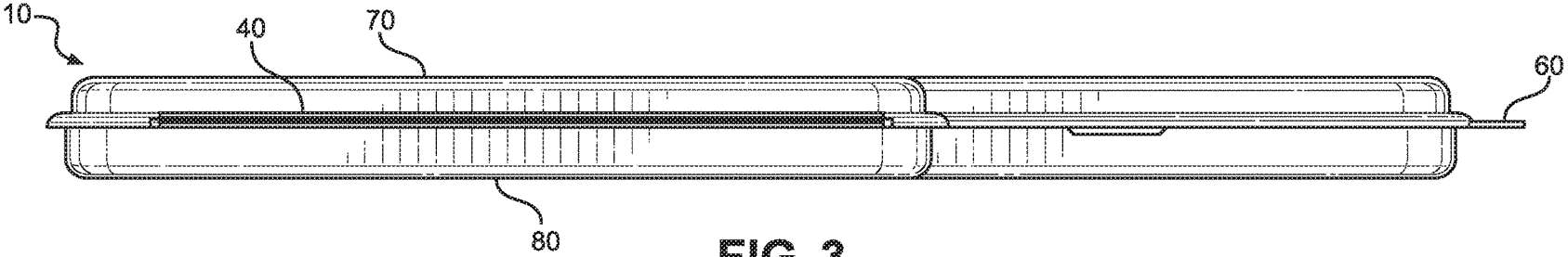
FIG. 3 is a side view of an embodiment of the present invention in a closed position.
Figure 4:
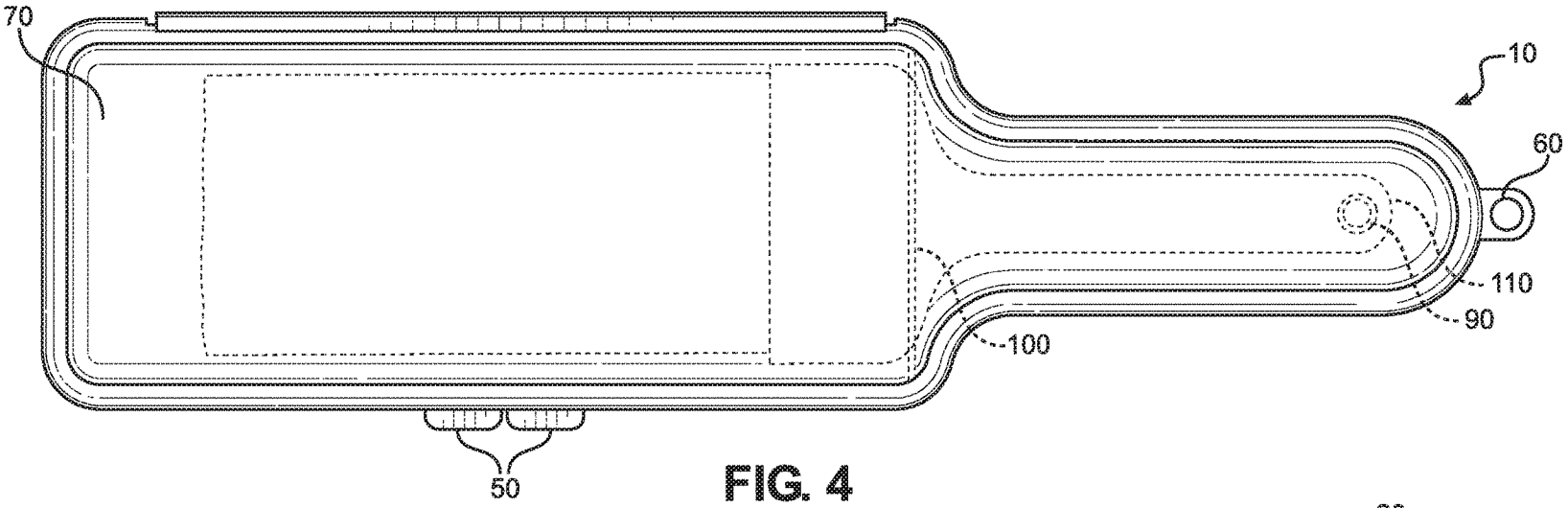
FIG. 4 is a top view of an embodiment of the present invention in a closed position.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an air tight wet paint brush storage device. This wet paint brush/roller storage box allows to preserve the wet paint brush/roller inside the box between coats and up to a month-time between jobs by providing air tight sealing. The present invention almost completely eliminates the messy manual cleaning process.

Referring to FIGS. 1 through 7, the present invention includes a paint application container 10. The paint application container 10 includes a first half 70 and a second half 80. The first half 70 includes an inner upper edge 12 and an outer upper edge 14 defining a continuous channel 16 therebetween. The second half 80 includes a continuous upper edge 18. The continuous upper edge 18 of the second half 80 aligns with and entirely fits within the continuous channel 16 of the first half 70. A receptacle 22 is defined in between the first half 70 and the second half 80. The receptacle 22 sized to fit a paint applicator 110, 140 therein. At least one clamp 24 releasably couples the first half 70 to the second half 80 to hold the continuous upper edge 18 within the continuous channel 16 and create an air tight seal between the receptacle and outside air. The continuous upper edge 18 and the continuous channel 16 act as a male-female locking mechanism running continuously along the periphery to provide an air tight seal when the container 10 is closed.

In certain embodiments, each of the first half 70 and the second half 80 may include recessed inner surfaces 31, 34 defining the receptacle. In such embodiments, the first half 70 may include a sidewall 32 upstanding from a periphery of the recessed inner surface 31. The inner upper edge 12 and the outer upper edge 14 are defined on a top of the sidewall 32 of the first half 70. The second half 80 may also include a sidewall 36 upstanding from a periphery of the recessed inner surface 34. The continuous upper edge 18 is defined on a top of the sidewall of the second half. In other embodiments, either the first half 70 or the second half 80 is substantially flat and acts as a lid and the other of the first half 70 and the second half 80 includes a recess to define the receptacle sized to receive the entire paint application 110, 140. In certain embodiments, each of the first half 70 and the second half 80 includes a wide head portion 37 to fit the bristles of a paint brush 110 and a narrow handle portion 38 to fit the handle of the paint brush 110. In other embodiments, the head portion 37 and the handle portion 38 have the same dimensions such that the container 10 has a rectangular cuboid shape.

In certain embodiments, the present invention may include a hinge 40 coupling the first half 70 and the second half 80 on a first side. In such embodiments, the clamp 24 releasably couples the first half 70 and the second half 80 on a second side, opposite the first side. The hinge 40 may be a living hinge, the hinge 40 pivotally connects the first half 70 to the second half 80 on the first side. Alternatively, the present invention may include a plurality of clamps 24 disposed about the perimeter and on the first and second sides of the container 10, in which a hinge 40 is not necessary.

The clamp 24 or clamps 24 may be any type of connector that holds the first half 70 against the second half 80, such as but not limited to latches, clasps, rubber bands, ties, and the like. As mentioned above, the clamp 24 may include a plurality of clamps 24 extending downward from the first half 70 at the head portion 37 and the handle portion 38. Each of the clamps 24 may include a flexible barb that locks onto a flange formed by the upper continuous edge 18 of the second half 80 when a force is applied to urge the first half 70 against the second half 80. For example, the clamp 24 may be a latch similar to a cantilever with the flexible barb protruding inwards from the first half 70 to completely secure the container 10 after storing the brush 110. The clamps 24 provide a mechanical means to open and close the container 10 and access to paint brush 110. The present invention may further include handle tabs 50 extending from outer edges of the first half 70 and second half 80. Urging the handle tabs 50 together urges the plurality of clamps 24 to engage the flange. Urging the handle tabs 50 away from one another opens the container 10.

The present invention may further include rubber ribs 100 that accommodate the paint applicator 110, 140 at an incline within the container 10 to support the paint brush bristles. In such embodiments, a first rubber rib 100 extends from a first side to a second side of an inner surface of the first half 70 where the wide head portion 37 meets the narrow handle portion 38. A second rubber rib 100 extends from a first side to a second side of an inner surface of the second half 80 where the wide head portion 37 meets the narrow handle portion 38.

In certain embodiments, the present invention may include at least one peg 90 protruding from an inner surface of the second half 80 within the handle portion. The peg 90 may be a vertical post, which protrudes upwards to anchor the paint brushes 110 during storage. For example, the peg 90 may fit through an opening of the paint brush handle.

The present invention may further include a hanger tab 60 extending from the handle portion of the first half 70, second half 80, or bother. The hanger tab 60 includes an opening. The opening allows a user to hang the container 10 vertically with the bristles hanging downwards to maintain its shape during longer storage.

Figure 7:
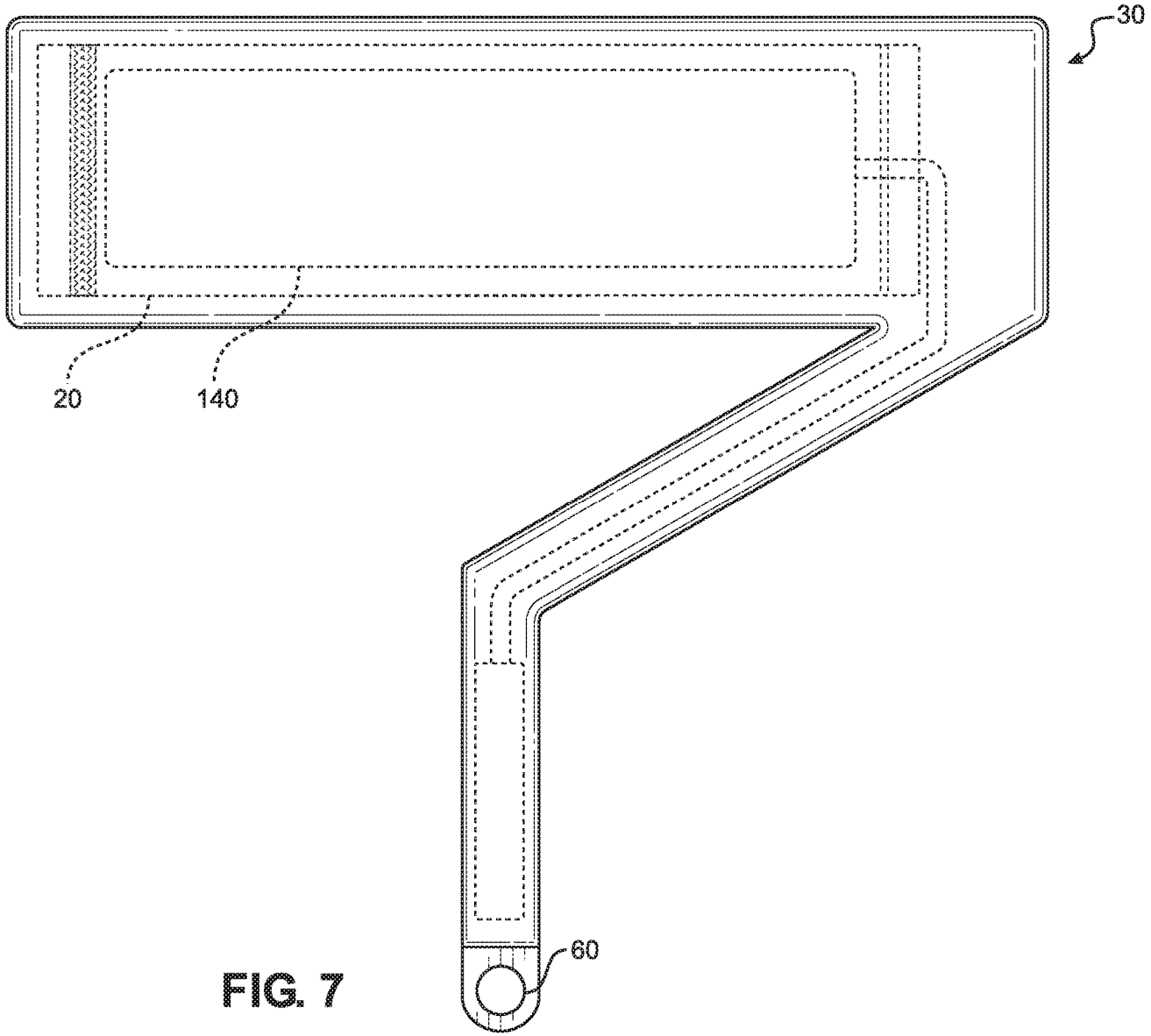
FIG. 7 is a top view of an embodiment of the present invention in a closed position.

The paint application 110, 140 may include a paint brush 110 or a paint roller 140. For a paint brush 110, the container 10 may include an outer shape of a paint brush 110 and is sized to contain the paint brush 110 within. As illustrated in FIG. 7, for a paint roller 140, the container 30 may include an outer shape of a paint roller 140 and is sized to contain the paint roller 140 within.

Figure 5:
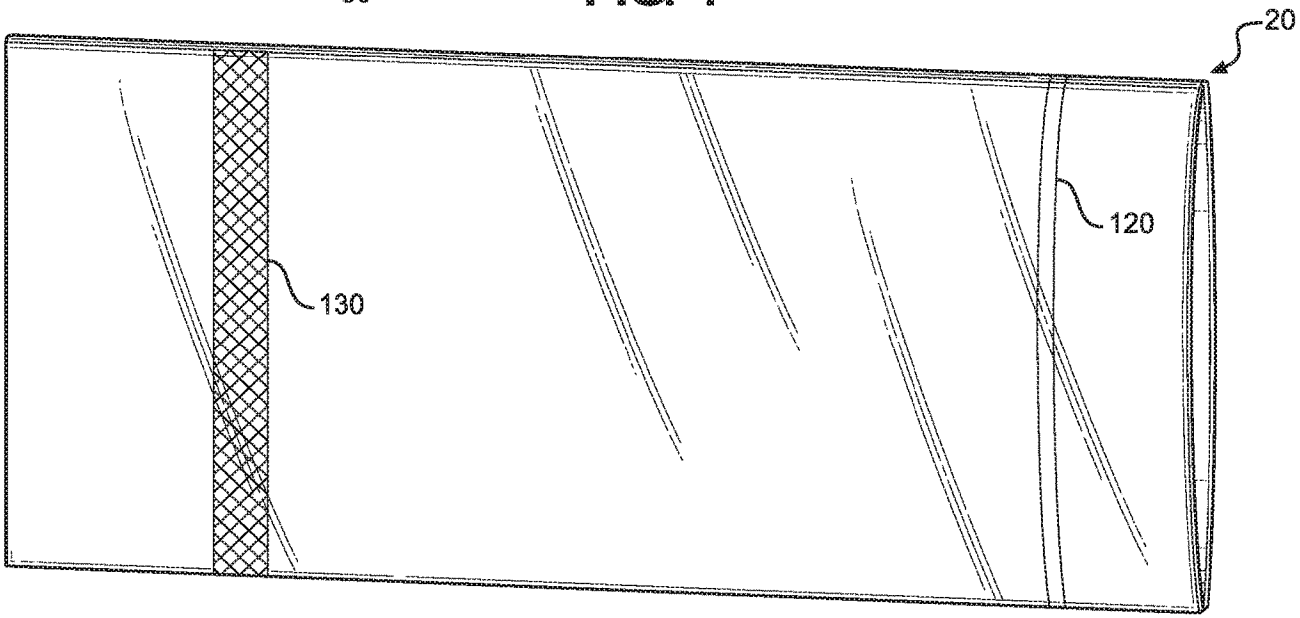
FIG. 5 is a perspective view of a brush zip bag of an embodiment of the present invention.
Figure 6:
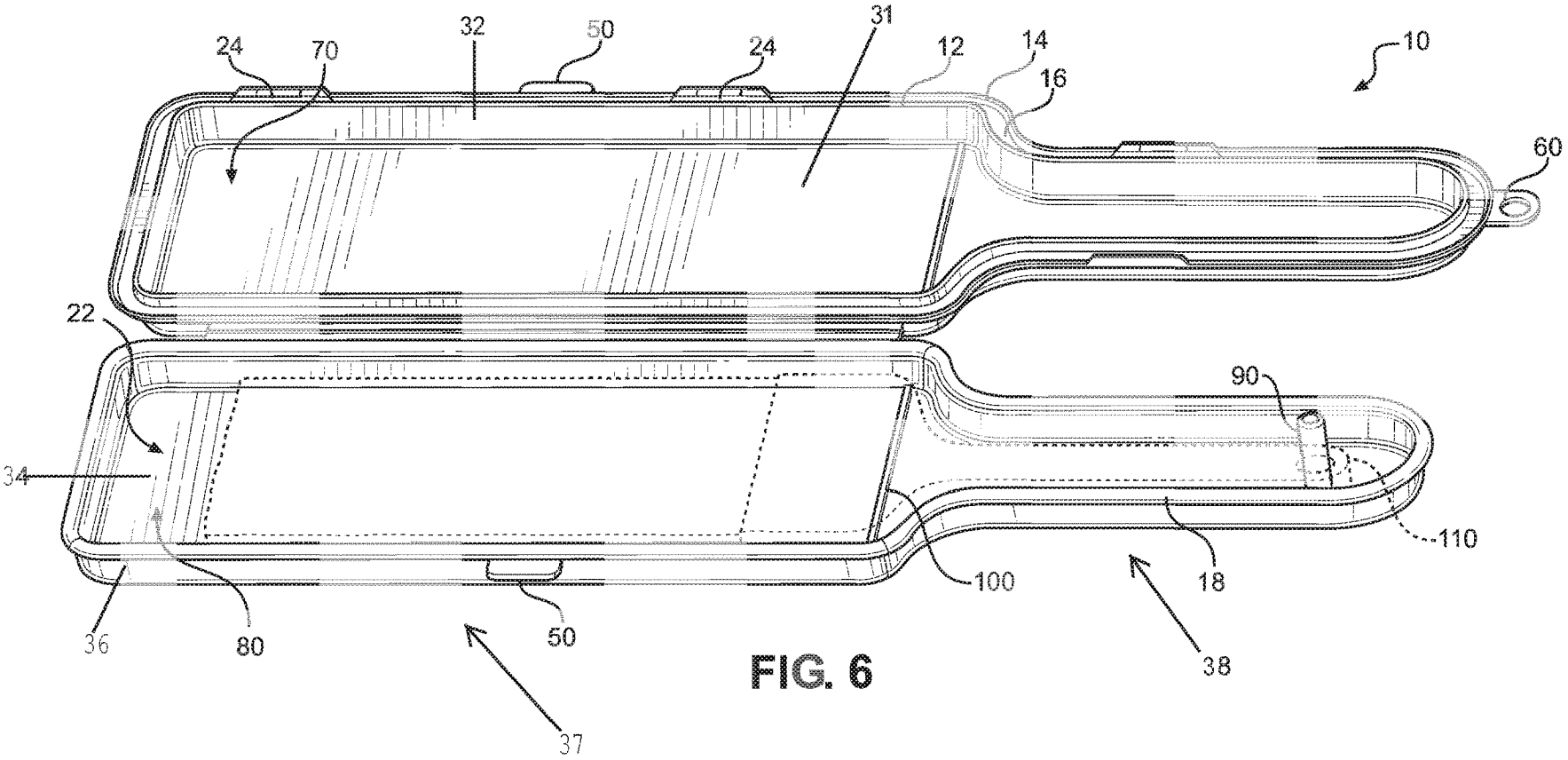
FIG. 6 is a perspective view of an embodiment of the present invention in an opened position.

As illustrated in FIG. 5, the present invention may further include a zip-lock polybag 20 with a tip portion/area to hold and insert the paint brushes and paint rollers, body area, a seal 130 between the body portion and bottom portion, and a bottom area. A weld seal 130 across polybag 20 width can be achieved preferably with heat or by synthetic adhesive or with a zipper. The body area receives wet paint brushes and paint rollers to contain paint dripping during storage. After storing the brush or roller, zipper lock 120 is applied to secure it, and placed over the storage container 10. For the next paint job, the bottom area is held with fingers and brush or roller is removed from the polybag 20.

The present invention is used to store wet paint brush/roller. This is provided by designing the container with top part (described above as "first half") and bottom part (described above as "second half"), connecting the parts by means of hinge provision preferably located along partition line and at the center portion of the storage container, the hinge provides a convenient means to operate the box. The male-female design geometry running along the periphery of the container where top part and bottom part of the box meets provides an air tight seal to the container. This feature permits a means to store the wet paint brush inside the container and preserve it in wet conditions in-between painting jobs without drying the paint brush/roller and without damaging the bristles or sensitive coating surfaces. The choices with vertical posts, their locations, and box handle and body design allows storing paint brushes having different sizes and shapes. The design of ribs across from first side to second side on bottom part as well as on top part accommodate the paint applicator at an incline within the container to support the paint brush bristles.

The curved design around the box corners prevents any sharp turns and also provides an easy clean-up if required. The present invention and design geometry provide a means to store a variety of paint brushes having different sizes and shapes. This present invention also offers a complete air tight seal without any open area or stem within the box. Because with an open area and its requirements for a synthetic seal to cover it, cannot offer a complete air tight seal, and also synthetic seal gets damaged during its use that compromising the air tight seal design of the storage container. Therefore, with the present invention, wet paint brushes can be stored for longer time, and this present design provides a sturdy and durable container.

The wet paint brush/roller storage box may be made in one-step injection molded process, or multi-step film conversion and thermoforming process. A synthetic plastic resin is pressurized, melted, and injected into to a/multiple mold cavity of the die design to produce products. A mold design is to be carved first with allowable thickness tolerances for injection molding process, this allows one to produce storage box with bottom and top part, hinge, and box handle in one single step.

The present invention allows one to store wet paint brush/roller, so during its use, open the box, store the wet paint brush, and then securely close it to maintain the wet conditions of the brush. And for the next use, simply open the box and use the paint brush as it is in the preserved wet conditions. Variety of fields and technologies can adopt this invention. For example, industrial mixers, to be able to reuse between jobs, need a provision to store the mixers in an air tight storage container.

It should be understood, of course, that the foregoing relates to exemplary embodiments of the invention and that modifications may be made without departing from the spirit and scope of the invention as set forth in the following claims.

What is claimed is:

1. A paint applicator container comprising:

a first half comprising an inner upper edge and an outer upper edge each disposed along an entire periphery of the first half and defining a continuous channel therebetween;

a second half comprising a continuous upper edge disposed along an entire periphery of the second half; and a plurality of clamps, wherein the continuous upper edge of the second half entirely fits within the continuous channel of the first half, a paint applicator receptacle is defined in between the first half and the second half, and the plurality of clamps are disposed about the perimeter of the paint applicator container and releasably couple the first half to the second half to hold the continuous upper edge within the continuous channel and create an air tight seal between the receptacle and outside air;

wherein the plurality of clamps extend downward from the first half and each clamp comprises a flexible barb locking onto a flange of the second half when a force is applied to urge the first half against the second half; and wherein each of the first half and the second half comprise a wide head portion and a narrow handle portion, further comprising a first rubber rib extending from a first side to a second side of an inner surface of the first half where the wide head portion meets the narrow handle portion, and a second rubber rib extending from a first side to a second side of an inner surface of the second half where the wide head portion meets the narrow handle portion.

2. The paint applicator container of claim 1, further comprising a hinge coupling a first side of the first half and a first side of the second half, wherein the plurality of clamps releasably couples a second side of the first half and a second side of the second half, wherein the second side of the first half is opposite the first side of the first half and the second side of the second half is opposite the first side of the second half.

3. The paint applicator container of claim 1, further comprising handle tabs extending from outer edges of the first half and second half, wherein urging the handle tabs together urges the plurality of clamps to engage the flange.

4. The paint applicator container of claim 1, wherein each of the first half and the second half comprise a recessed inner surface defining the receptacle.

5. The paint applicator container of claim 1, further comprising a hanger tab extending from the handle portion of the first half, the hanger tab comprising an opening.

6. The paint applicator container of claim 1, wherein the first half and the second half each comprise a recessed inner surface and a sidewall upstanding from the recessed inner surface, wherein the inner upper edge and the outer upper edge are defined on a top of the sidewall of the first half and the continuous upper edge is defined on a top of the sidewall of the second half.

7. A paint applicator container comprising:

a first half comprising an inner upper edge and an outer upper edge each disposed along an entire periphery of the first half and defining a continuous channel therebetween;

a second half comprising a continuous upper edge disposed along an entire periphery of the second half; and a plurality of clamps, wherein the continuous upper edge of the second half entirely fits within the continuous channel of the first half, a paint applicator receptacle is defined in between the first half and the second half, and the plurality of clamps are disposed about the perimeter of the paint applicator container and releasably couple the first half to the second half to hold the continuous upper edge within the continuous channel and create an air tight seal between the receptacle and outside air;

wherein the plurality of clamps extend downward from the first half and each clamp comprises a flexible barb locking onto a flange of the second half when a force is applied to urge the first half against the second half; and wherein each of the first half and the second half comprise a wide head portion and a narrow handle portion, further comprising a peg protruding from an inner surface of the second half within the handle portion.

8. The paint applicator container of claim 7, further comprising a hinge coupling a first side of the first half and a first side of the second half, wherein the plurality of clamps releasably couples a second side of the first half and a second side of the second half, wherein the second side of the first half is opposite the first side of the first half and the second side of the second half is opposite the first side of the second half.

9. The paint applicator container of claim 7, further comprising handle tabs extending from outer edges of the first half and second half, wherein urging the handle tabs together urges the plurality of clamps to engage the flange.

10. The paint applicator container of claim 7, wherein each of the first half and the second half comprise a recessed inner surface defining the receptacle.

11. The paint applicator container of claim 7, further comprising a hanger tab extending from the handle portion of the first half, the hanger tab comprising an opening.

12. The paint applicator container of claim 7, wherein the first half and the second half each comprise a recessed inner surface and a sidewall upstanding from the recessed inner surface, wherein the inner upper edge and the outer upper edge are defined on a top of the sidewall of the first half and the continuous upper edge is defined on a top of the sidewall of the second half.

* * * * *